US005417830A

United States Patent [19]

Tsurushima

[11] Patent Number: 5,417,830

[45] Date of Patent: May 23, 1995

[54] INJECTION PLATING APPARATUS

[75] Inventor: Kuniaki Tsurushima, Atsugi, Japan

[73] Assignee: Kabushiki Kaisha Toshiba, Kawasaki, Japan

[21] Appl. No.: 159,561

[22] Filed: Dec. 1, 1993

[30] Foreign Application Priority Data

Dec. 2, 1992 [JP] Japan ..... 4-323020

[51] Int. Cl.[6] ..... C25D 5/02; C25D 17/00; C25D 21/10

[52] U.S. Cl. ..... 204/224 R; 204/275

[58] Field of Search ..... 204/224 R, 275; 118/301

[56] References Cited

U.S. PATENT DOCUMENTS

| | | | |
|---|---|---|---|
| 3,695,909 | 10/1972 | Fabre et al. | 118/301 X |
| 4,339,319 | 7/1982 | Aigo | 204/224 R |
| 4,518,636 | 5/1985 | Richards | 204/224 R |
| 5,228,966 | 7/1993 | Murata | 204/224 R |

*Primary Examiner*—Donald R. Valentine
*Attorney, Agent, or Firm*—Finnegan, Henderson Farabow, Garrett & Dunner

[57] ABSTRACT

An injection plating apparatus for uniformly plating external leads of a semiconductor product having a lead-missing portion. The injection plating apparatus comprises cavity boxes for compressing a semiconductor product. Masks, attached to the cavity boxes, serve as masks in plating injection for covering at least a lead-missing portion of the semiconductor product. The injection plating apparatus further comprises means for plating the external leads of the semiconductor product.

6 Claims, 6 Drawing Sheets

INJECTION PLATING APPARATUS

BACKGROUND OF THE INVENTION

1. Field of the Invention

The present invention relates to an improved injection plating apparatus for plating the external leads of a semiconductor product.

2. Description of the Related Art

FIGS. 1 to 3 shows a conventional injection plating apparatus. FIG. 2 is a cross sectional view of the apparatus of FIG. 1 taken along the line I—I' and FIG. 3 is a cross sectional view of the apparatus of FIG. 1 taken along the line II–II'.

A plating liquid is injected from a plating liquid reservoir to a cavity 13 through pressure boxes 11 and 12. A semiconductor product 14 is compressed by cavity boxes 15 and 16 from both sides. Electrodes 17 are formed on portions of inner surfaces of the cavity boxes (portions opposed to each other and separated from external lead surfaces). When the plating liquid is injected, a positive voltage is applied to the electrodes and a negative voltage is applied to lead frames 18.

With injection plating apparatus of this type, a semiconductor product having external leads arranged at regular intervals on both sides can be satisfactorily plated. However, if the leads of a semiconductor product are not arranged at regular intervals as shown in FIGS. 4A, 4B and 5, the thickness of a plate layer formed thereon cannot be made uniform.

For example, in an SOJ 26-pin package, three central pins are missing on each side. Thus, the package actually has 20 pins. When the external leads of such a semiconductor product are plated with the above-mentioned injection plating apparatus, end pins (Nos. 5, 9, 18 and 22 shown in FIG. 4B) are plated thicker than the other pins for the following reasons: first, plating liquid flows faster in a central portion (lead-missing portion) than any other portion; and second, currents are concentrated on the end pins 5, 9, 18 and 22 shown in FIG. 4B.

FIG. 6 shows the thickness of plate layers formed on the respective pins (Nos. 1 to 13 shown in FIG. 5) which have been subjected to a plating process by the above-mentioned injection plating apparatus. As clearly shown in FIG. 6, the thickness of the plate layers on the end pins (Nos. 5 and 9 shown in FIG. 5) is about 80% to 90% greater than those of the other pins.

SUMMARY OF THE INVENTION

As described above, the conventional injection plating apparatus cannot form a plate layer having a uniform thickness on a semiconductor product on which leads are not arranged at regular intervals.

The present invention has been made to overcome the above drawback, and its object is to provide an injection plating apparatus for forming a uniform plate layer on leads irregularly arranged on a semiconductor product.

To achieve the above object, the injection plating apparatus of the present invention comprises: cavity boxes for fixing a semiconductor product; masks for use in plating injection, which cover at least a lead-missing portion of the semiconductor product; and means for plating external leads of the semiconductor product.

The injection plating apparatus of the present invention comprises cavity boxes having a projection for covering at least the lead-missing portion of the semiconductor product and means for plating the external leads of the semiconductor product.

Further, a plurality of cavities can be formed by the projection of the cavity boxes on both sides of the lead missing portion. The projection is detachable from the cavity box.

With the above construction, the mask of the injection plating apparatus covers at least the lead-missing portion of the semiconductor product. In addition, the projection covers at least the lead-missing portion of the semiconductor product. Hence, plating liquid is prevented from flowing faster in the lead-missing portion and currents are prevented from becoming concentrated at end pins, with the result that the external leads of the semiconductor product can be plated uniformly.

Furthermore, if a plurality of cavities are formed by projections of the cavity boxes on both sides of the lead missing portion of the semiconductor product, the thickness of the plate on the external leads can be much more uniform.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be described with reference to the accompanying drawings.

Figure 1:
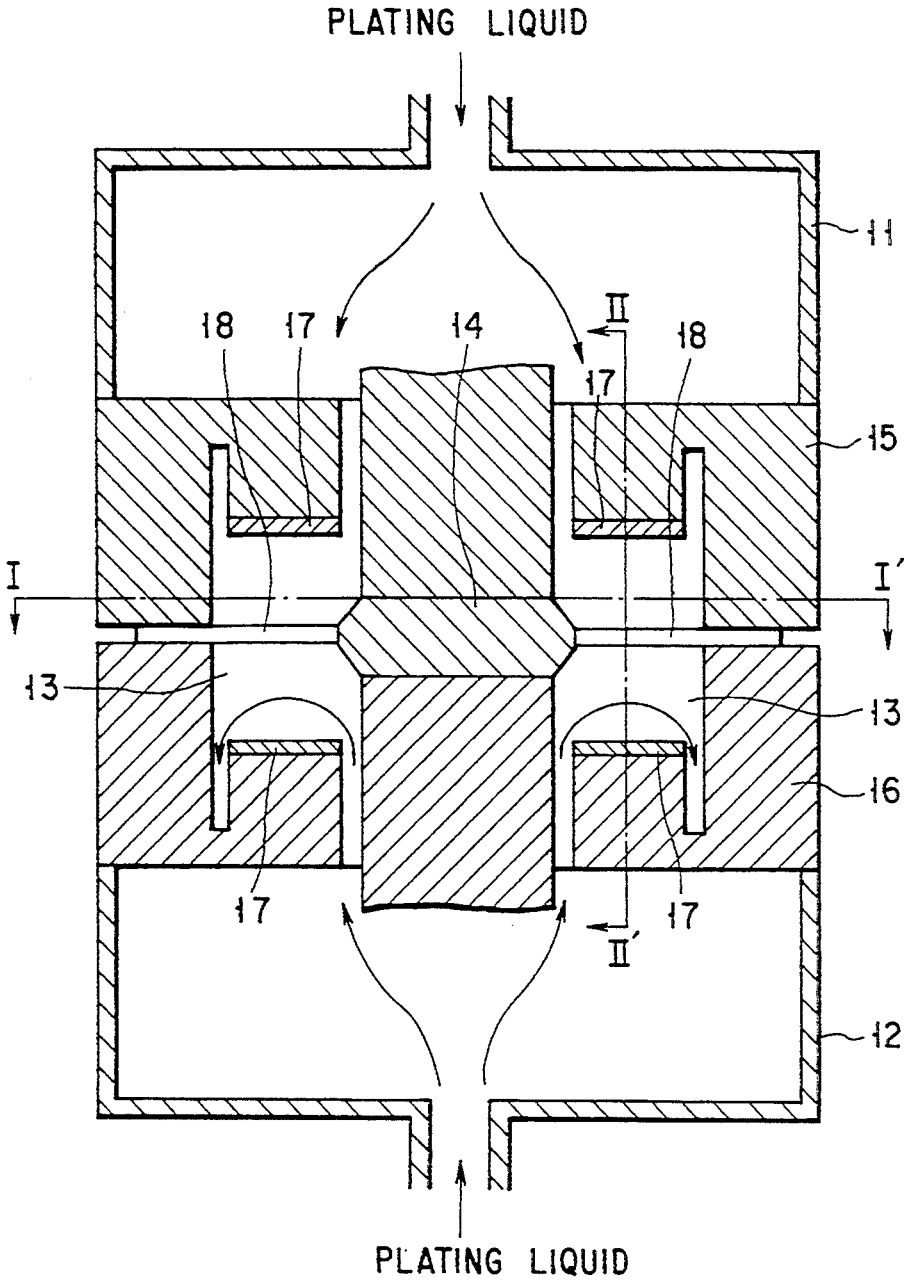
FIG. 1 PRIOR ART
FIG. 1 is a diagram showing a conventional injection plating apparatus.
Figure 2:
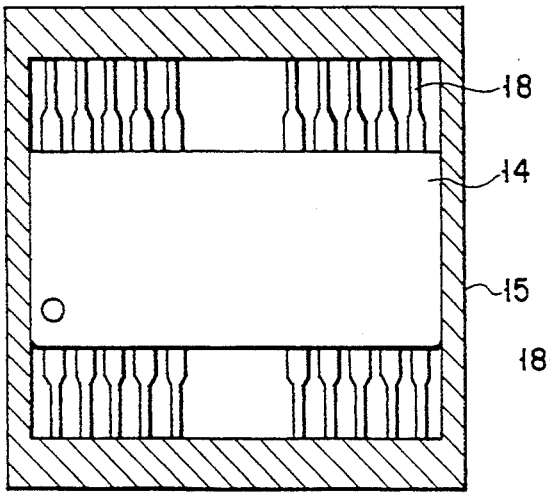
FIG. 2 PRIOR ART
FIG. 2 is a cross-sectional view of the apparatus shown in FIG. 1, taken along the line I—I' in FIG. 1.
Figure 3:
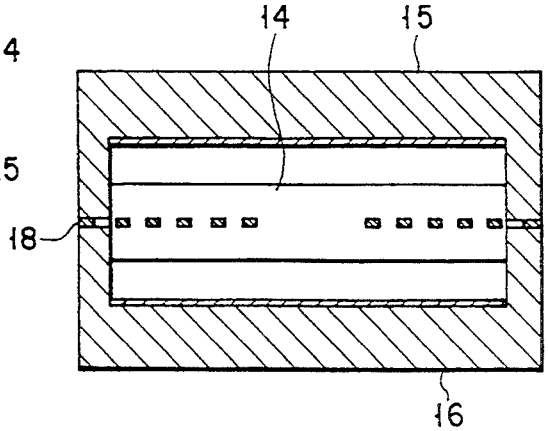
FIG. 3 PRIOR ART
FIG. 3 is a cross-sectional view of the apparatus shown in FIG. 1, taken along the line II–II' in FIG. 1.
Figure 7:
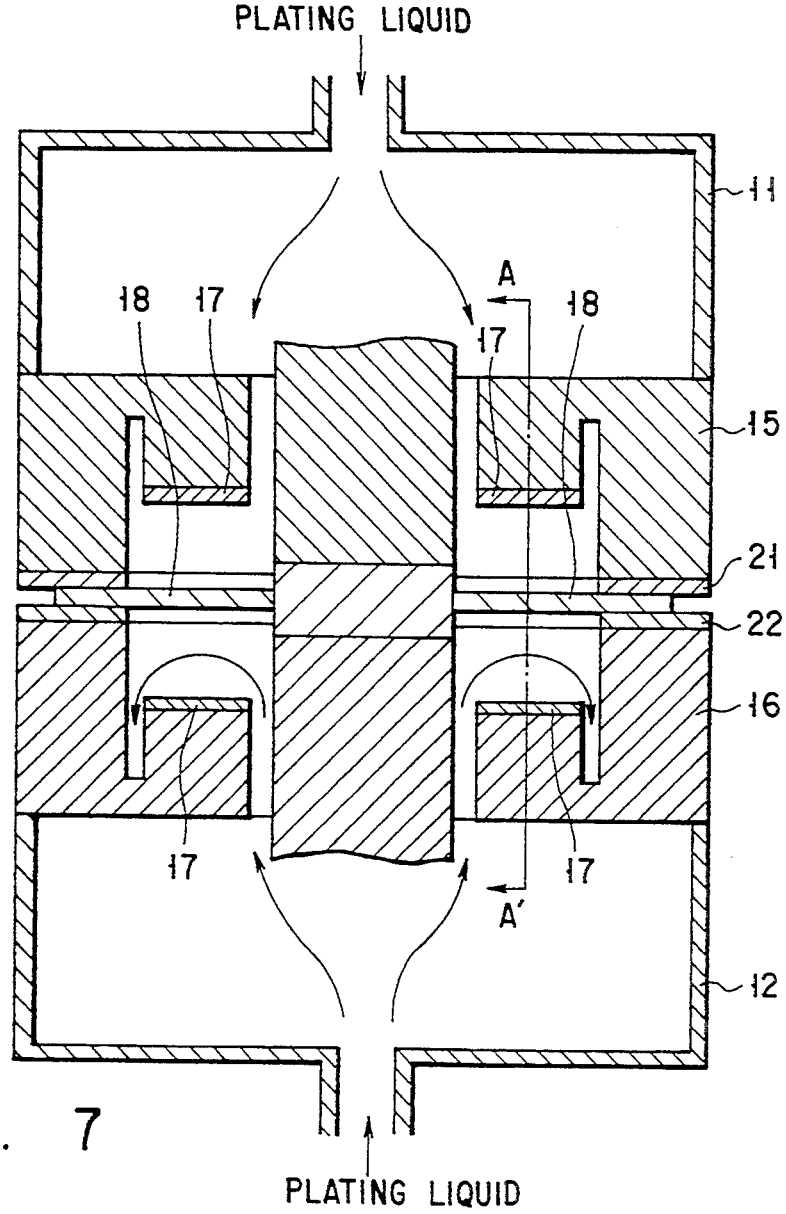
FIG. 7 is a diagram showing an injection plating apparatus according to an embodiment of the present invention.

FIG. 7 shows an injection plating apparatus according to an embodiment of the present invention. In FIG. 7, similar components are identified with similar reference numerals as in FIG. 1, and detailed descriptions thereof are omitted.

The injection plating apparatus of this embodiment differs from the conventional injection plating apparatus in that masks 21 and 22 for use in the plating injection are attached to cavity boxes 15 and 16.

Figure 8:
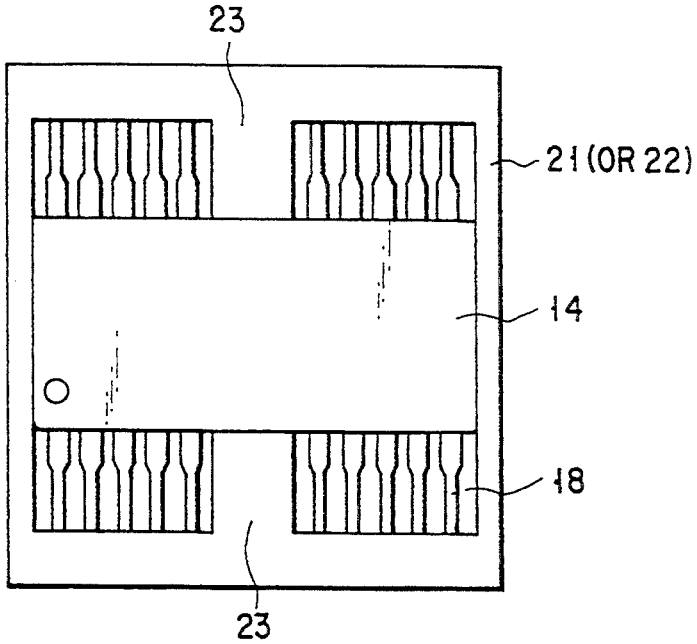
FIG. 8 is a diagram showing the positional relationship between the mask and the semiconductor product shown in FIG. 7.
Figure 9:
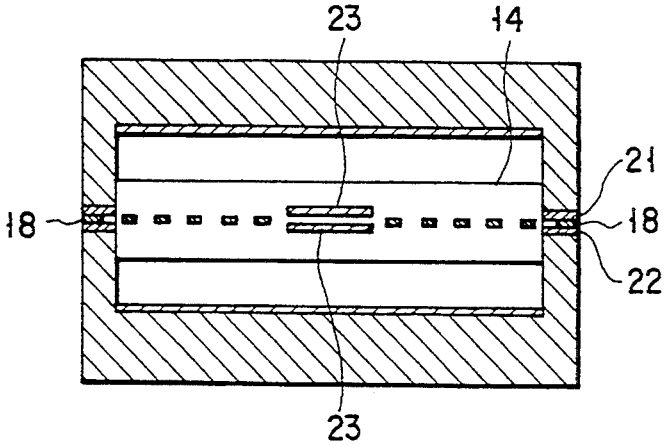
FIG. 9 is a cross-sectional view of the apparatus shown in FIG. 7, taken along the line A—A' in FIG. 7.

FIG. 8 is a diagram showing the positional relationship between the mask 21 (or 22) of the injection plating apparatus and a semiconductor product 14 shown in FIG. 7. FIG. 9 is a cross-sectional view of the apparatus shown in FIG. 7, taken along the line A—A'.

The semiconductor product 14 is, for example, a SOJ 26-pin package, in which three central pins are missing on each side. The masks 21 and 22 are provided on portions of the cavity boxes 15 and 16 which sandwich a lead frame 18. Each of the masks 21 and 22, having a substantially rectangular shape, has an opening corresponding to a portion (cavity) where the external leads are plated. Each mask 21 or 22 has a projection 23 for covering a lead-missing portion of the semiconductor product 14. The masks 21 and 22 can be formed integrally with the cavity boxes 15 and 16, respectively.

With the above construction, the drawback of the conventional art can be overcome: plating liquid is prevented from flowing faster in the lead-missing portion and currents are prevented from becoming concentrated at end pins. As a result, the external leads of the semiconductor product can be plated uniformly.

Figure 6:
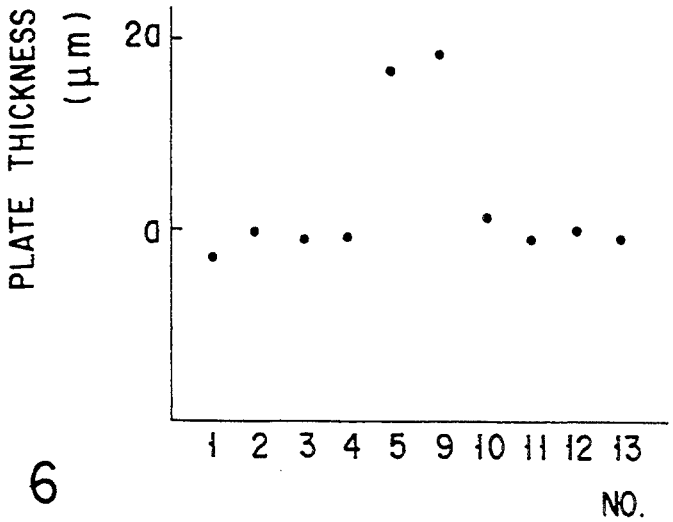
FIG. 6 is a graph showing the relationship between a pin number and a plate thickness.
Figure 10:
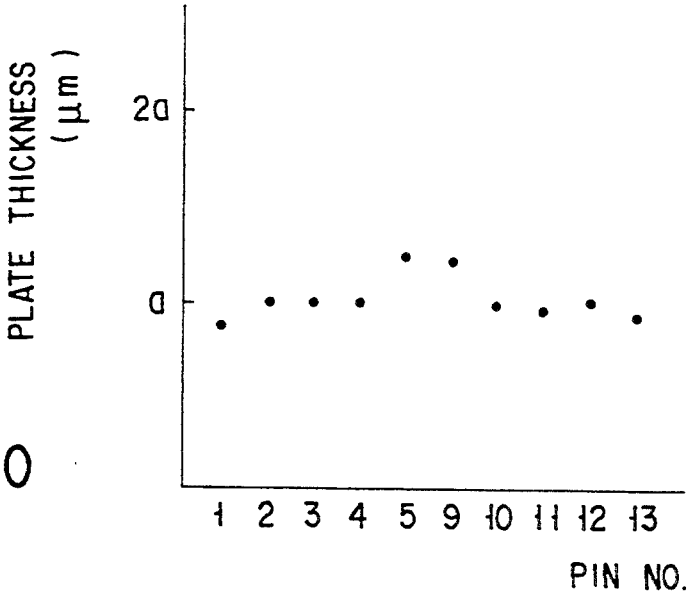
FIG. 10 is a graph showing the relationship between a pin number and a plate thickness.

FIG. 10 shows the thickness of plate layers formed on the respective pins (Nos. 1 to 13) which have been subjected to a plating process by the injection plating apparatus of the present invention. As clearly shown in FIG. 10, the pins are plated more uniformly as compared to the case of the conventional art shown in FIG. 6. End pins (5 and 9) are merely 20 to 30% thicker than the other pins.

Figure 11:
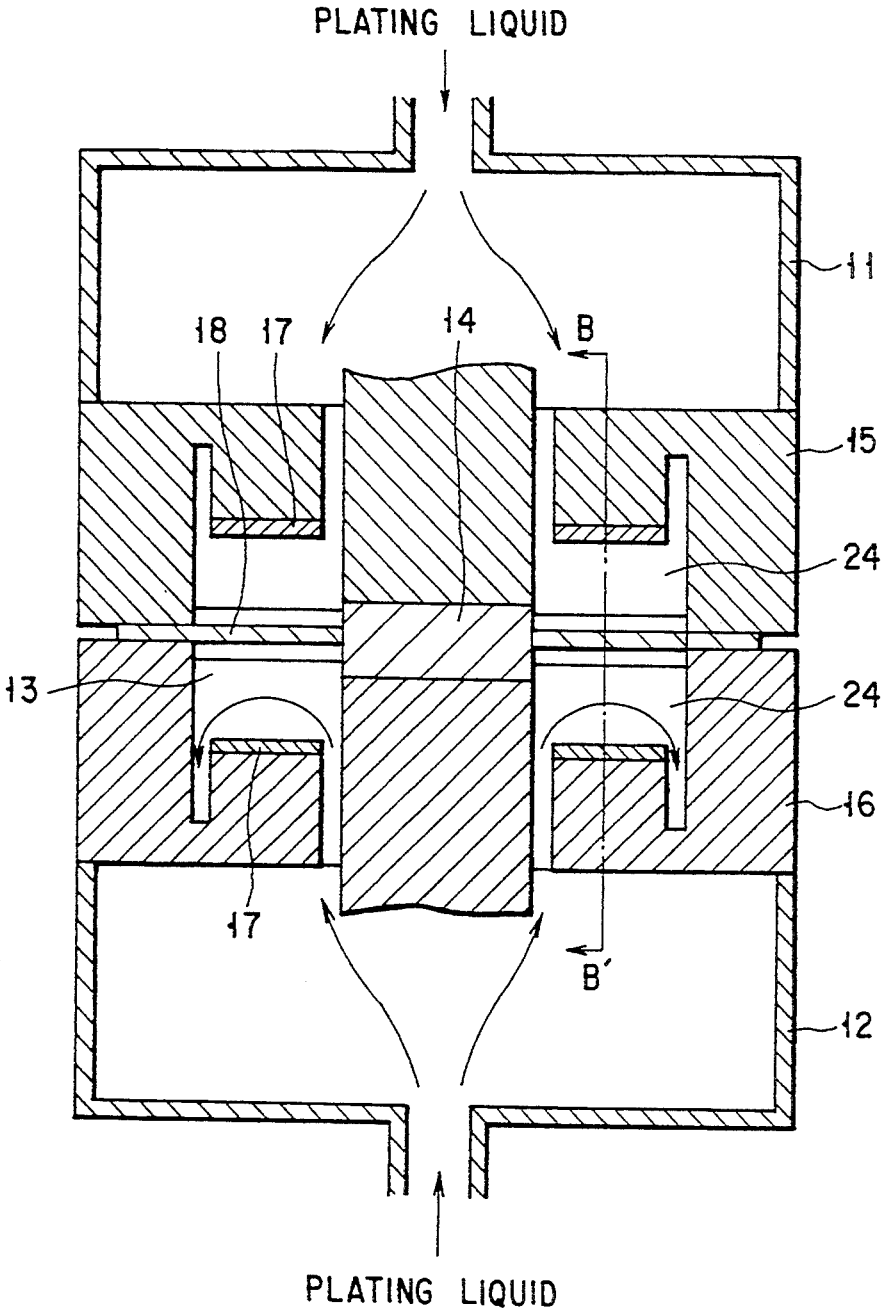
FIG. 11 is a diagram showing an injection plating apparatus according to another embodiment of the present invention.

FIG. 11 shows an injection plating apparatus according to another embodiment of the present invention. In FIG. 11, similar components are identified with similar reference numerals as in FIG. 1, and detailed descriptions thereof are omitted.

The injection plating apparatus of this embodiment differs from the conventional injection plating apparatus in that cavity boxes 15 and 16 have projections 24 for covering a lead-missing portion of the semiconductor product 14.

Figure 12:
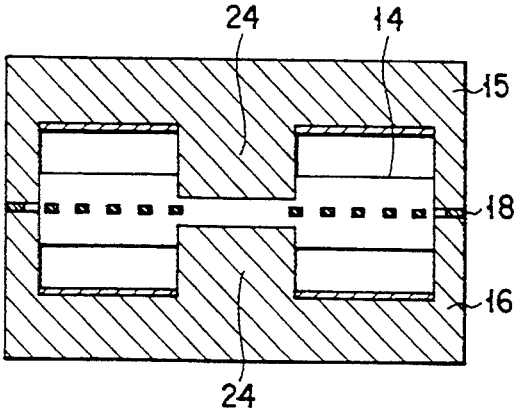
FIG. 12 is a cross-sectional view of the apparatus shown in FIG. 11, taken along the line B—B' in FIG. 11.

FIG. 12 is a cross-sectional view of the apparatus of FIG. 11, taken along the line B—B' of FIG. 11. In FIGS. 11 and 12, the semiconductor product 14 is, for example, a SOJ 26-pin package, in which three central pins are missing on each side. In this embodiment, projections 24 are protruded from the inner walls of the cavity boxes 15 and 16 so as to cover a lead-missing portion of the semiconductor product 14.

Figure 5:
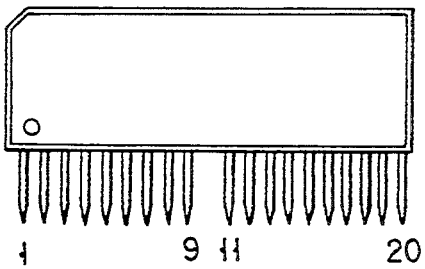
FIG. 5 is a diagram showing a conventional semiconductor product.

With this construction, the flow of a plating liquid in the cavity can be uniform and the currents are prevented from being concentrated at the end pins, thereby plating the pins uniformly. This embodiment is effective particularly for a semiconductor product in which the width of a lead-missing portion is small, for example, a ZIP 20-pin package (a lead-missing 19-pin package) as shown in FIG. 5.

Figure 13:
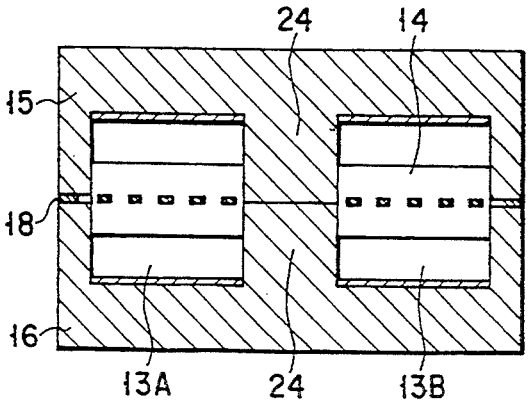
FIG. 13 is a diagram showing main part of an injection plating apparatus according to still another embodiment of the present invention.

FIG. 13 shows a modification of the injection plating apparatus shown in FIG. 12, in which projections of cavities 15 and 16 are brought into contact with each other. With this construction, independent cavities 13A and 13B are formed on both sides of the semiconductor product 14. External leads (Nos. 1 to 5) are located in the cavity 13A and external leads (Nos. 9 to 13) are located in the cavity 13B.

Figure 4A:
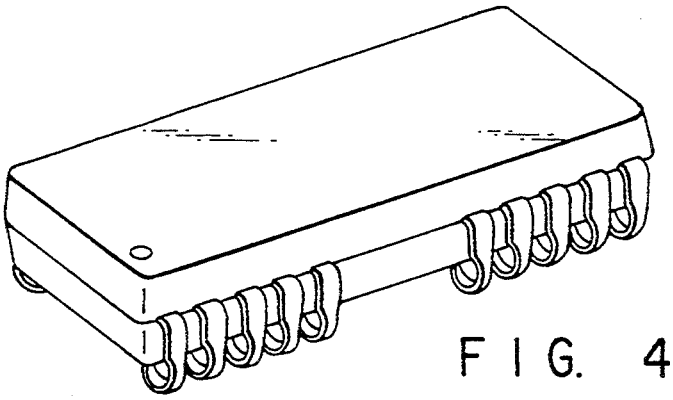
FIGS. 4A and 4B are diagrams showing a conventional semiconductor product.
Figure 4B:
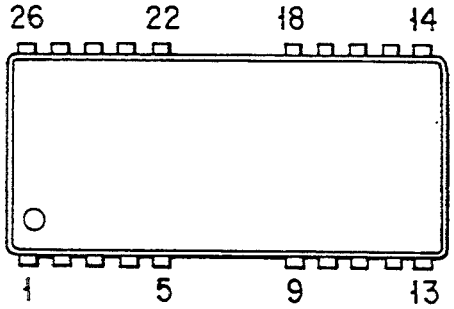

With this construction also, the flow of a plating liquid in the cavity can be uniform and the currents are prevented from being concentrated at the end pins, thereby plating the pins uniformly. This embodiment is effective particularly for a semiconductor product in which the width of a lead-missing portion is great, for example, a SOJ 20-pin package (a lead-missing 20-pin package) as shown in FIG. 4.

Figure 14:
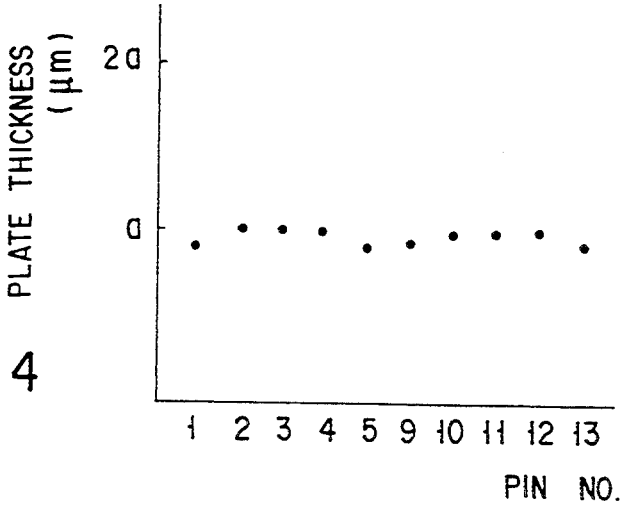
FIG. 14 is a diagram showing the relationship between a pin number and a plate thickness.

FIG. 14 shows the thickness of plate layers formed on the respective pins (Nos. 1 to 13) which have been subjected to a plating process by the injection plating apparatus of the present invention. As clearly shown in FIG. 14, the pins are plated more uniformly as compared to the case shown in FIG. 10.

Figure 15:
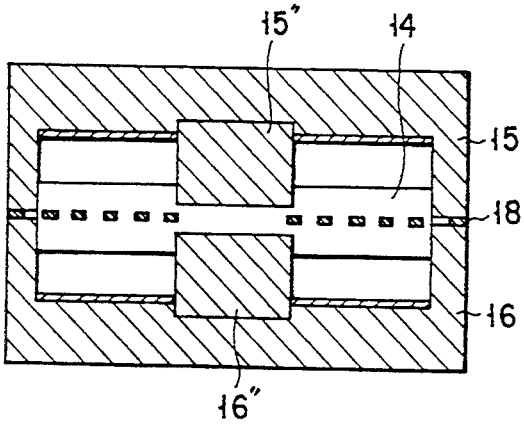
FIG. 15 is a diagram showing main part of an injection plating apparatus according to a further embodiment of the present invention.
Figure 16:
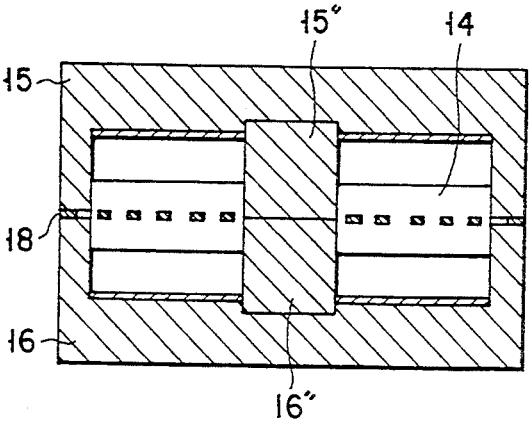
FIG. 16 is a diagram showing main part of an injection plating apparatus according to a still further embodiment of the present invention.

FIGS. 15 and 16 show modifications of the injection plating apparatuses shown in FIGS. 12 and 13. More specifically, the construction shown in FIG. 15 uses members (baffles) 15" and 16" detachable from the cavity boxes 15 and 16, in replace of the projections 24 shown in FIG. 13, and the construction shown in FIG. 16 uses members (baffles) 15" and 16" detachable from the cavity boxes 15 and 16, in place of the projections 24 shown in FIG. 13.

In these modifications, if grooves are formed in the cavity boxes 15 and 16 and the members 15" and 16" are slightly greater than the grooves, the members 15" and 16" can easily be engaged with the grooves. It is preferable that the members 15" and 16" be formed of an insulating material.

The injection plating apparatus of the present invention as described above has the following advantages.

The masks of the present plating apparatus have a configuration so as to cover at least the lead-missing portion of the semiconductor product. Alternatively, the cavity boxes have the projections for covering the lead-missing portions of the semiconductor product. With this construction, since the plating apparatus is free from the drawbacks that the flow rate of a plating liquid is increased near the lead-missing portions and currents are concentrated at end pins, the external leads of the semiconductor product can be plated uniformly. Moreover, if a plurality of cavities are formed by the projections of the cavity boxes on both sides of the lead missing portion of the semiconductor product, the thickness of the plating layer formed on the external leads can be much more uniform.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An injection plating apparatus comprising:
cavity boxes for fixing a semiconductor product;
masks for use in plating injection, which cover at least a lead-missing portion of the semiconductor product; and
electrode means for electroplating external leads of the semiconductor product.

2. An injection plating apparatus comprising:
cavity boxes for fixing a semiconductor product and having projections which cover at least a lead-missing portion of the semiconductor product; and
electrode means for electroplating external leads of the semiconductor product.

3. The injection plating apparatus according to claim 2, wherein cavities are formed by the projections of the cavity boxes on both sides of the lead-missing portion of the semiconductor product.

4. The injection plating apparatus according to claim 1 or 2, wherein the projections are detachable from the cavity boxes.

5. An injection plating apparatus comprising:
cavity boxes for fixing a semiconductor product having external leads;
masks for use in plating injection, which cover at least a lead-missing portion of the semiconductor product; and
electrodes for receipt of a voltage when the cavity boxes contain a plating liquid, to plate the external leads of the semiconductor product with the plating liquid.

6. An injection plating apparatus comprising:
cavity boxes for fixing a semiconductor product having external leads, the cavity boxes having a projection which covers at least a lead-missing portion of the semiconductor product; and
electrodes for receipt of a voltage when the cavity boxes contain a plating liquid, to plate the external leads of the semiconductor product with the plating liquid.

* * * * *